United States Patent [19]

Rehrig

[11] 3,964,636

[45] June 22, 1976

[54] BOX FOR ENCASING A BAG CONTAINING LIQUID

[76] Inventor: Houston Rehrig, 4010 E. 26 St., Los Angeles, Calif. 90023

[22] Filed: Feb. 27, 1974

[21] Appl. No.: 446,477

[52] U.S. Cl. ..... 220/306; 220/342; 220/63 R; 220/83; 220/DIG. 6; 206/509; 222/143; 222/183

[51] Int. Cl.[2] ..... B65D 25/34; B65D 21/02

[58] Field of Search ..... 222/183, 185, 105, 131, 222/143; 220/83, 337, 338, 340, 342, 343, 306, DIG. 12, DIG. 14, 63 R, DIG. 6; 206/511, 509, 503

[56] References Cited

UNITED STATES PATENTS

| | | | |
|---|---|---|---|
| 1,644,001 | 10/1927 | Telschow | 220/306 |
| 2,831,610 | 4/1958 | Dennie | 222/185 X |
| 3,191,810 | 6/1965 | Johnston | 222/185 X |
| 3,212,681 | 10/1965 | Weikert | 222/185 X |
| 3,343,719 | 9/1967 | Kastamo et al. | 222/105 X |
| 3,383,009 | 5/1968 | Weikert | 220/342 X |
| 3,506,154 | 4/1970 | Barnes | 220/83 |
| 3,642,967 | 2/1972 | Doll | 220/83 X |
| 3,746,206 | 7/1973 | Utz | 220/343 X |
| 3,802,595 | 4/1974 | Frahm et al. | 220/83 X |
| 3,837,533 | 9/1974 | Splan | 222/185 X |

FOREIGN PATENTS OR APPLICATIONS

| | | | |
|---|---|---|---|
| 221,413 | 5/1962 | Austria | 220/306 |
| 2,086,553 | 12/1971 | France | 220/83 |
| 1,096,183 | 12/1967 | United Kingdom | 206/509 |

*Primary Examiner*—Stanley H. Tollberg
*Assistant Examiner*—Charles A. Marmor

[57] ABSTRACT

A quadratic box formed of six panels, one of which is hinged to function as a lid. A removable plastic bag for containing liquid is encased within the box. A large portion of each of the panels is of open lattice construction with strengthening ribs. Sections of solid construction are provided at some points to enable the box to withstand the pressure of the liquid contained in the encased bag. The hinges attaching the lid each comprise a shaft carried by one panel seated in a recess formed in another panel, the shaft being held in place in the groove by a removable metal spring clip that closes the top of the recess. One of the end panels contains an opening through which a liquid dispensing tube can be extended, and this end panel is sloped toward the opening to allow complete drainage of liquid.

18 Claims, 22 Drawing Figures

20
130
7
49
142
46
48
42
140
40
44
38
30
30
38
28
26
24
28
10
34
32
8
8
36
38
7

BOX FOR ENCASING A BAG CONTAINING LIQUID

BACKGROUND OF THE INVENTION

This invention deals generally with containers and more particularly with containers for carrying liquid in bulk that is dispensed directly from the container.

It has become commonplace in recent years to dispense liquids from bulk storage containers holding some 10 gallons, for example, directly to the consumer. One of the best examples of this is the dispensing of milk by the glass in restaurants from a container housed in a refrigerated cabinet. Dispensing of edibles poses particular problems in the area of cleanliness. In the prior art, large milk cans have been utilized, equipped with a dispensing tube at the bottom, and housed in refrigerated cabinets. These containers were quite heavy in construction, and were expensive to manufacture and to handle. Furthermore, the metal containers were circular in cross-section, and thus there was much wasted capacity in the usual rectangular refrigerated cabinet, and there was wasted space in shipping, storing and stacking in refrigeration rooms and trucks, awaiting use.

More recently in the prior art there came into use coated paperboard containers of quadratic shape. The quadratic shape was certainly more efficient from the standpoint of effective space utilization. However, the paperboard containers were very fragile when filled, necessitating that they be placed in rigid shipping boxes for shipment and storage, and then removed immediately prior to use. They were difficult to handle even when simply being lifted into the cabinet, and were quite susceptible to leakage. The paperboard containers could not be reused, so they were discarded after use. This was a significant added expense.

To eliminate the problems of leakage, plastic bags or liners were placed inside the paperboard containers. However, this did not solve the other problems.

SUMMARY OF THE INVENTION

This invention eliminates the problems encountered in the prior art devices. It provides a self-supporting reusable container or box that encases a plastic bag filled with liquid. The plastic bag is discarded after use. The box is cleaned and sterilized for reuse.

The inventive box is most advantageously formed of six rectangular panels put together into a quadratic form. Five of the six panels are integrally formed together, preferably of plastic by injection molding, and the sixth panel, a lid, is hingedly attached. A plastic bag inside the box contains the liquid. The plastic bag is usually filled while the box is positioned on one end or on its side, and liquid is dispensed with the box positioned on one end. The panels are predominantly of open lattice construction, strengthened by ribs and solid portions. This provides a strong, lightweight box that can easily be cleaned and sterilized, inside and out. Its molded construction also facilitates cleaning by virtue of the absence of seams and fasteners.

The boxes are normally stored on their sides, stacked upon one another, each resting on a particular side panel, which is provided with legs. The lattice structure of this panel is of heavier construction than the lattice on the other panels, because it must support the weight of the liquid in the bag. The pressure of the liquid is also felt by the lowermost portions of the two adjacent upright side panels and the end panel, and therefore portions of these panels are of solid, not lattice, construction.

To dispense liquid from the bag, the box is placed upon one of its ends. That end panel is of solid construction, and is provided with an opening through which the neck and dispensing tube of the bag extend. The end panel is sloped toward the opening, to insure that all of the liquid is drained from the bag, so there is no waste. The aforementioned opening in the end panel has two portions, one larger than the other. The neck of the bag is positioned in the larger portion, and then pressed into the smaller portion, where it is held securely in place.

A novel hinge mechanism allows the lid easily to be attached and detached, yet is simple in construction and is easily cleaned. A hinge shaft on one panel is seated in an open recess on the adjacent panel. A metal hinge spring of generally U-shaped construction snaps into grooves flanking the recess, and closes the top of the recess to capture the shaft therein.

The lid is latched in the closed position by a latch comprising an opening in a lip extending from the lid in overlapping relationship to the adjacent side panel, with a protrusion molded upon the adjacent side panel. This simple design secures the lid without additional elements, and with a latch that is easy to operate and easy to clean.

To allow the box easily to be disengaged and removed from a deep injection mold, the side panels can be tapered inwardly slightly from top to bottom. If this be the case, the stacking legs provided on one of the panels are tapered in a reverse manner, outwardly from top to bottom, a magnitude twice that of the inward taper of the panel. This compensates for the inward taper of the panel upon which the legs are mounted, and for the inward taper of the panel of the adjacent box with which the legs make contact. Thus, the stack of boxes is straight and stable.

DESCRIPTION OF THE PREFERRED EMBODIMENTS

The box manufactured in accordance with this invention comprises a six sided quadratic envelope. Five side panels are rigidly attached together. The sixth side panel, hingidly attached to the others, can selectively be opened and closed to provide access to the interior. In order to facilitate explanation of the preferred embodiments of the invention, the panels are labeled front, rear, side, bottom and top to relate to the drawings, but this is for reference only, and should not be considered to be limiting.

Figure 1:
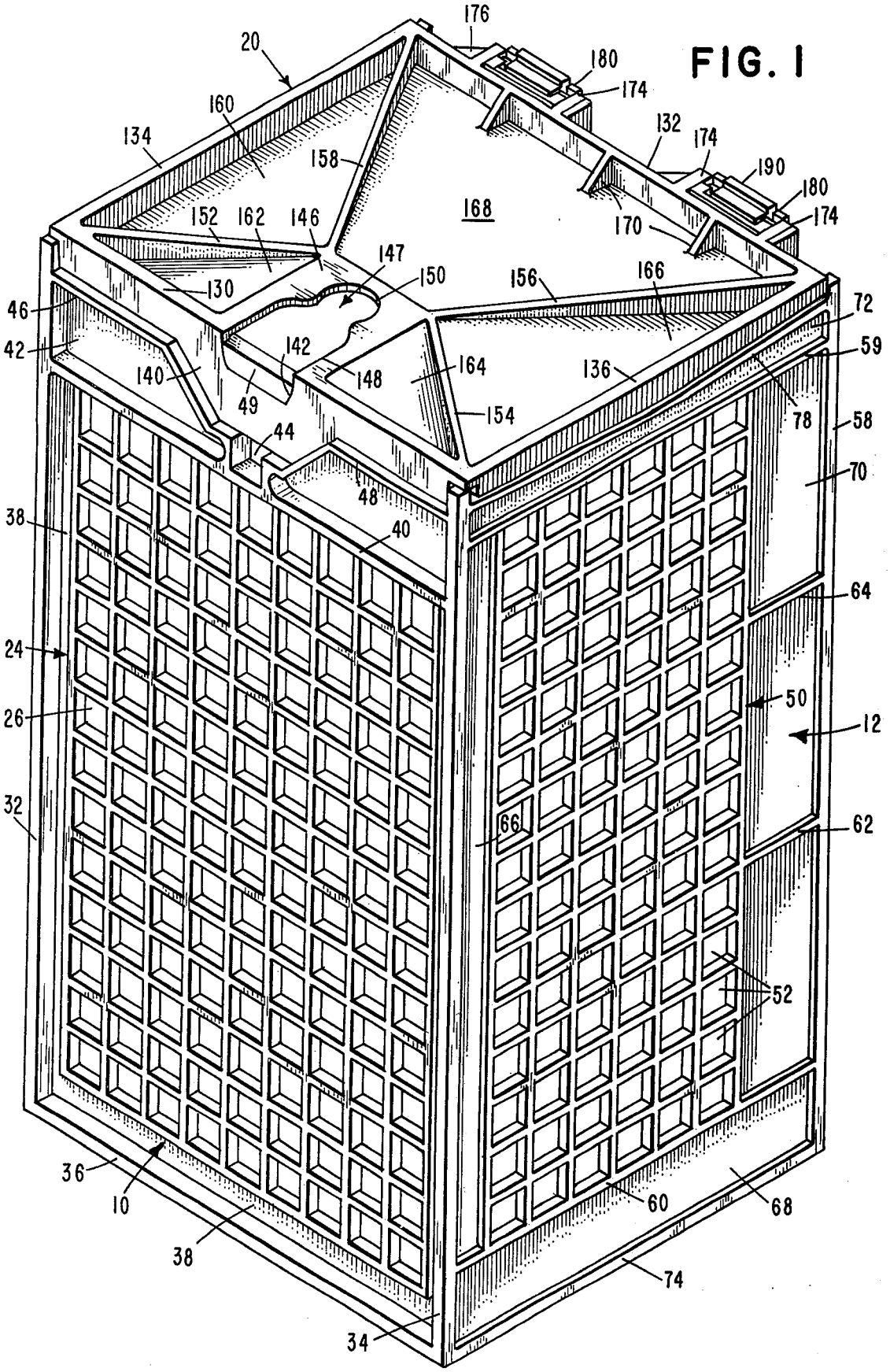
FIG. 1 is an isometric view of the first embodiment of a box constructed in accordance with the teachings of the invention.
Figure 9:
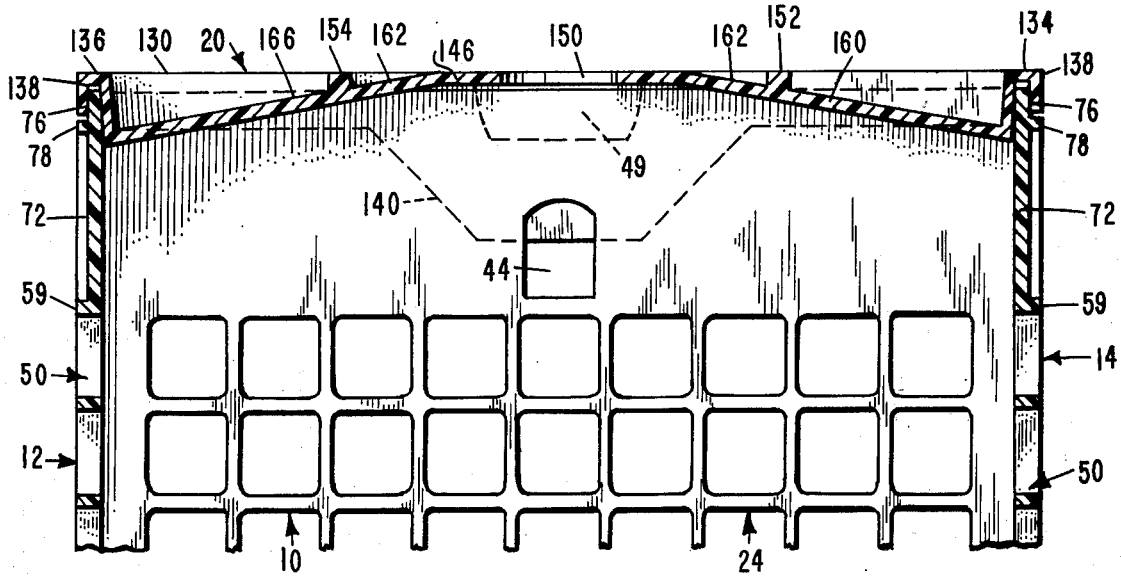
FIG. 9 is a view taken on line 9—9 of FIG. 5.
Figure 6:
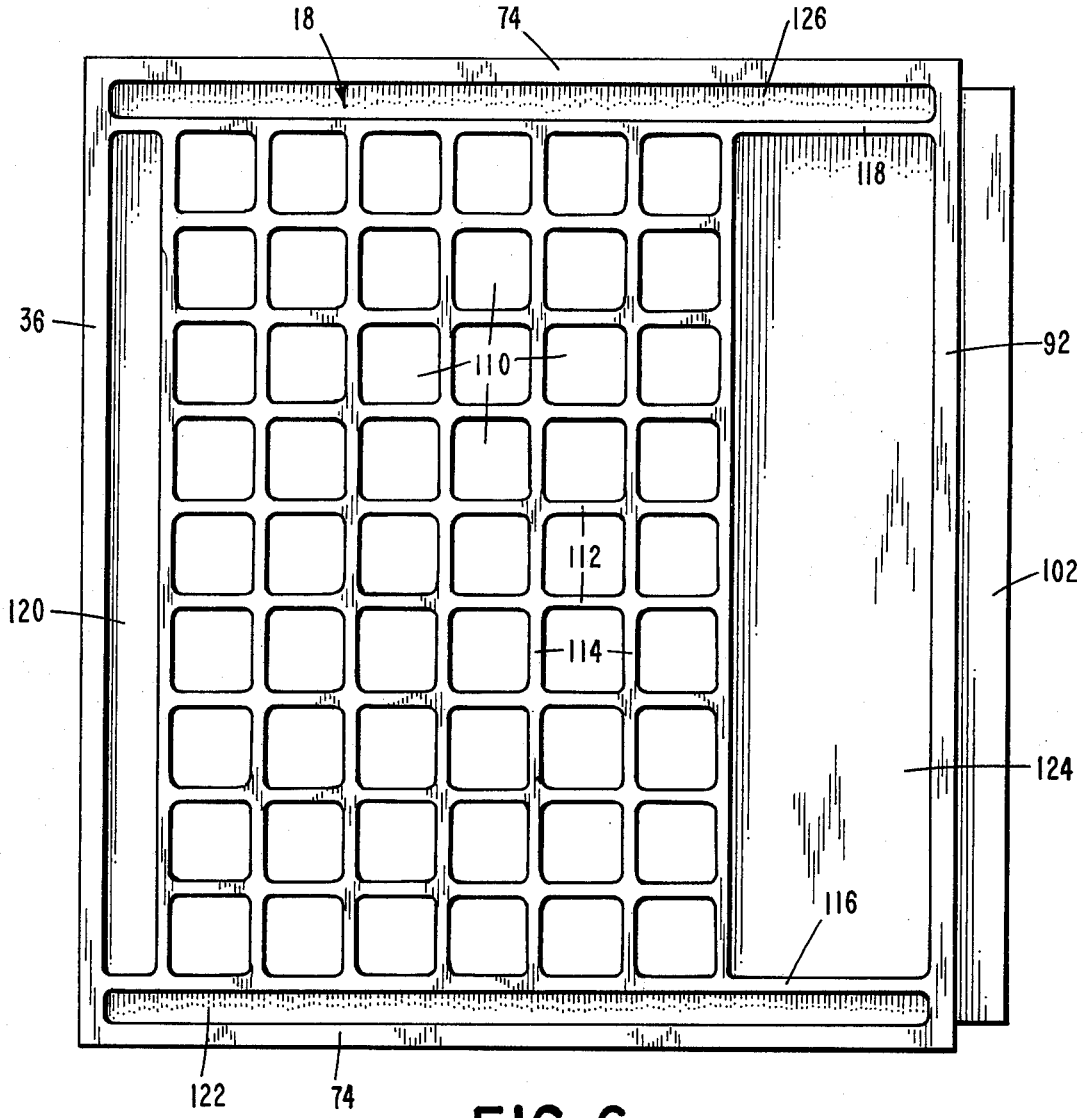
FIG. 6 is a botton plan view of the box shown in FIG. 1.

FIG. 1 shows a first embodiment of the invention, with the box standing upright, in which position the liquid containing liner is normally installed and filled with liquid. The box comprises a front panel 10, a right side panel 12, a left side panel 14 (FIGS. 8 and 9) that is identical to right side panel 12, a back panel 16 (FIG. 3), a bottom panel 18 (FIG. 6), and a top panel 20. Front panel 10, side panels 12 and 14, and back panel 16 are attached together at their contiguous edges, and bottom panel 18 is attached along its edges to these four panels. Preferably, these five panels are integrally molded in a single piece of plastic by conventional pressure molding techniques.

Front panel 10 (FIG. 2) comprises a central lattice portion 24, having a plurality of lattice openings 26 defined by horizontal lattice members 28 and vertical lattice members 30, which are integral with one another at their many junctures. The strength of lattice portion 24 is determined by the thickness and depth of lattice members 28 and 30. This will be discussed in more detail below. While rectangular lattice has been illustrated, other lattice patterns, such as diamond or honeycomb, could be used.

Figure 2:
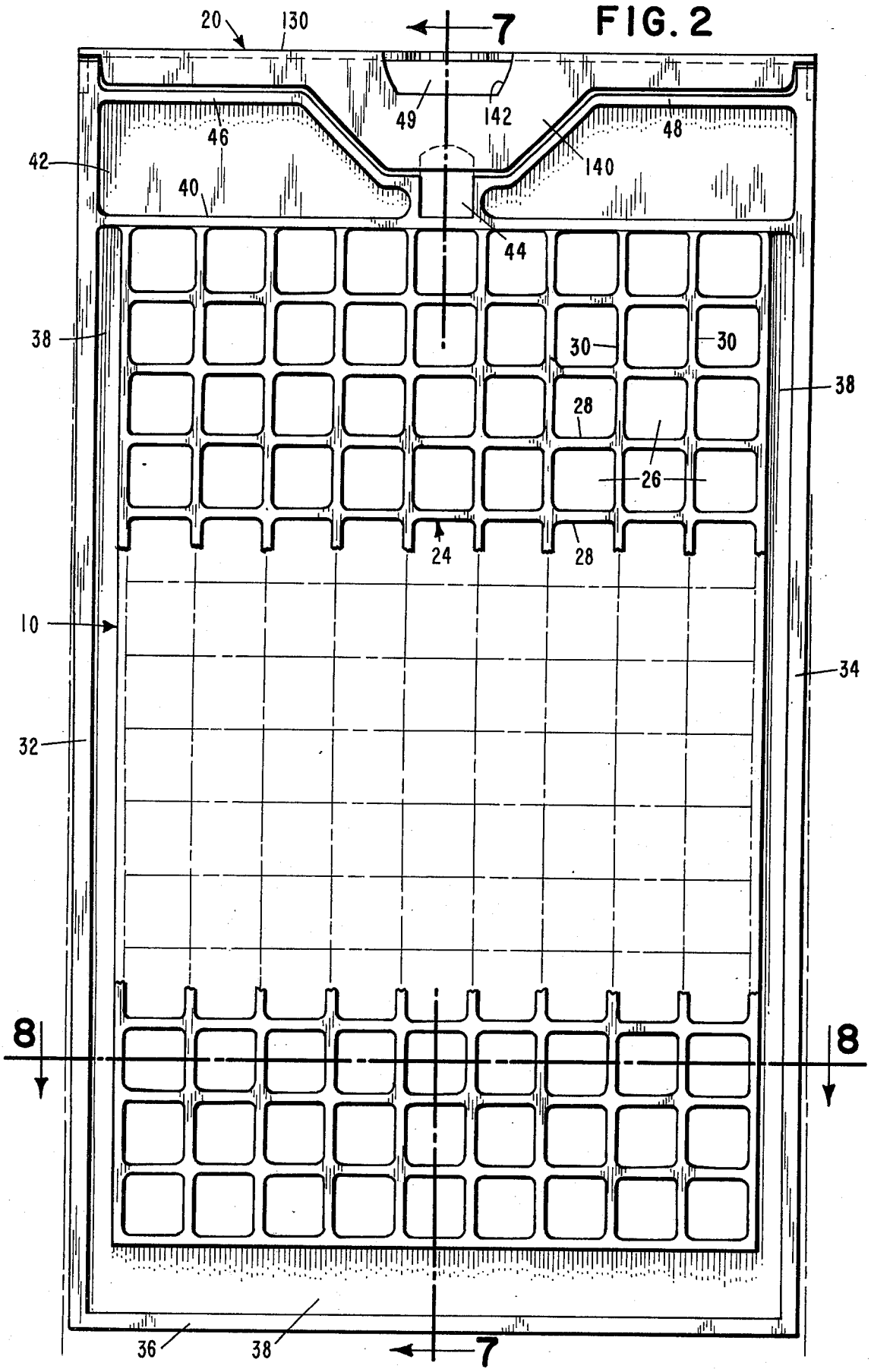
FIG. 2 is a front elevation of the box shown in FIG. 1.

The edges of front panel 10 are defined by a pair of corner members 32 and 34 which converge slightly from top to bottom, as viewed in FIG. 2. This convergence, and the similar convergence of side panels 12 and 14 and back panel 16, allow the box to be easily removed from a deep single cavity mold. By manufacturing the major part of the box in this manner, great strength is achieved, since all five panels are integral with one another. Moreover, the lack of seams and fasteners eliminates places where foreign matter can collect, thus facilitating cleaning and sterilization of the box for use. A bottom corner member 36 defines the bottom edge of front panel 10. A depressed solid section 38 is interposed between lattice 24 and corner members 32, 34 and 36, and is also integral with the other elements. Of course, while the various portions of this and the other panels are described as separate elements for clarity, it should be realized that these separately described elements are advantageously integrally formed with one another.

A horizontal rib 40 defines the upper limit of lattice 24. A solid section 42 is bounded by corner members 32 and 34 and rib 40, and extends to the upper edge of front panel 10. An opening 44 is provided in section 42 to enable lid 20 to be unfastened, as explained below. A pair of strengthening ribs 46 and 48 are also provided, dividing solid section 42 into three portions, the uppermost of which is covered by the lip of the lid, when the lid is closed. Ribs 46 and 48 join with rib 40, and with side corner members 32 and 34. At the mid point of the upper edge of solid section 42 is a raised fastening protrusion 49, that is engaged by the lid, as described below.

Figure 4:
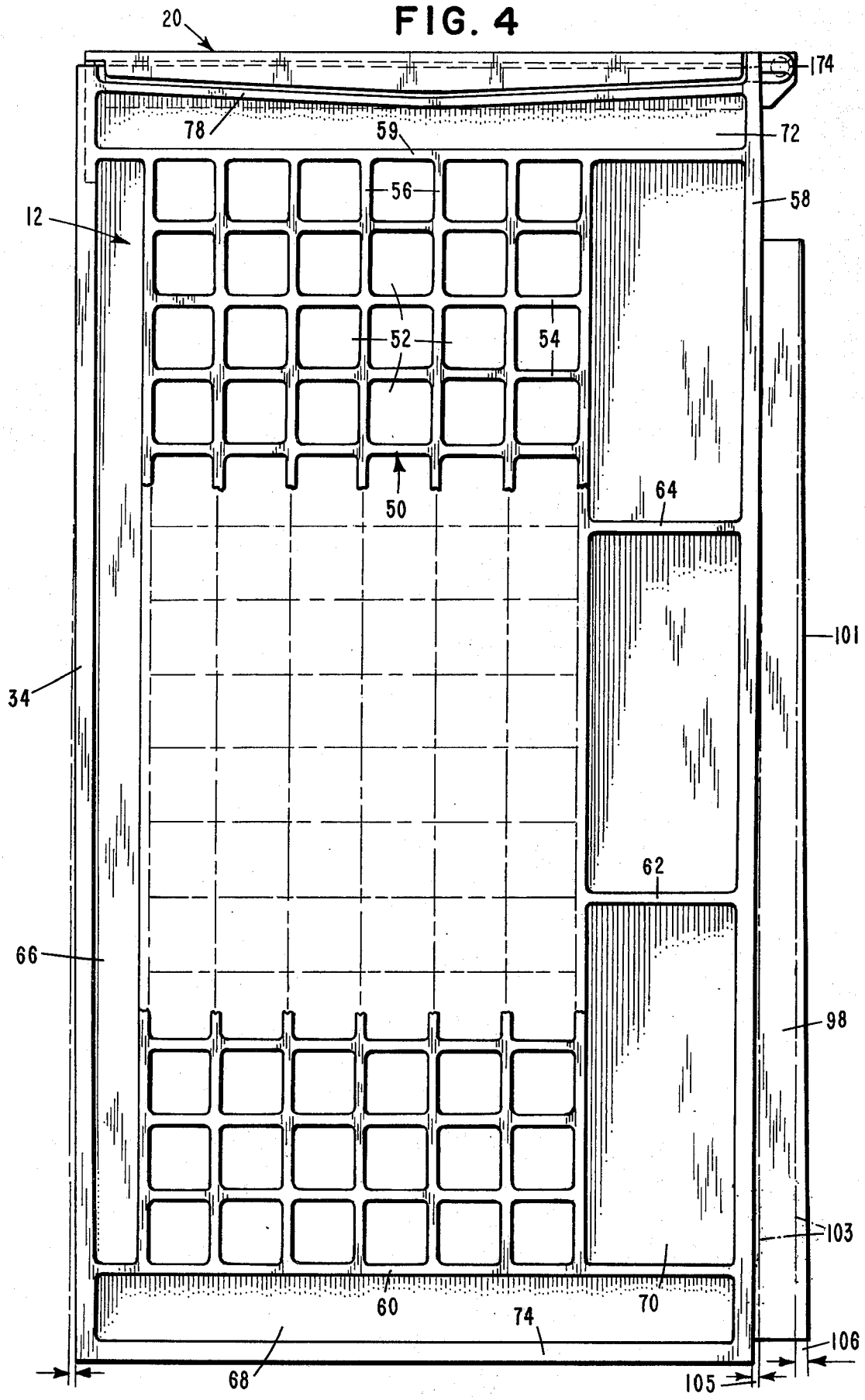
FIG. 4 is a side elevation of the box shown in FIG. 1.

FIG. 4 shows right side panel 12, of which left side panel 14 is simply a reversed duplicate. Right side 12 also has a central lattice portion 50, comprising lattice opening 52, defined by horizontal lattice members 54 and vertical lattice members 56. Right side panel 12 is bounded on the left by corner member 34, which is inclined inwardly as to side panel 12 as it was to front panel 10. On the right, right side panel 12 is bounded by another corner member 58, also inclined inwardly from top to bottom. A pair of long horizontal strengthening ribs 59 and 60 delineate solid sections 66, 68, 70 and 72. Solid section 70 is strengthened by a pair of ribs 62 and 64. Superposed upon solid section 72 is a curved strengthening rib 78. The lower edge of the panel terminates in a bottom edge member 74. Solid section 70 adds strength to panels 12 and 14 at that portion of each panel which is the lower portion when the box is on its side for storage and stacking. At this time, the outward pressure of the liquid bag is greater along the lower portion of panels 12 and 14.

Figure 3:
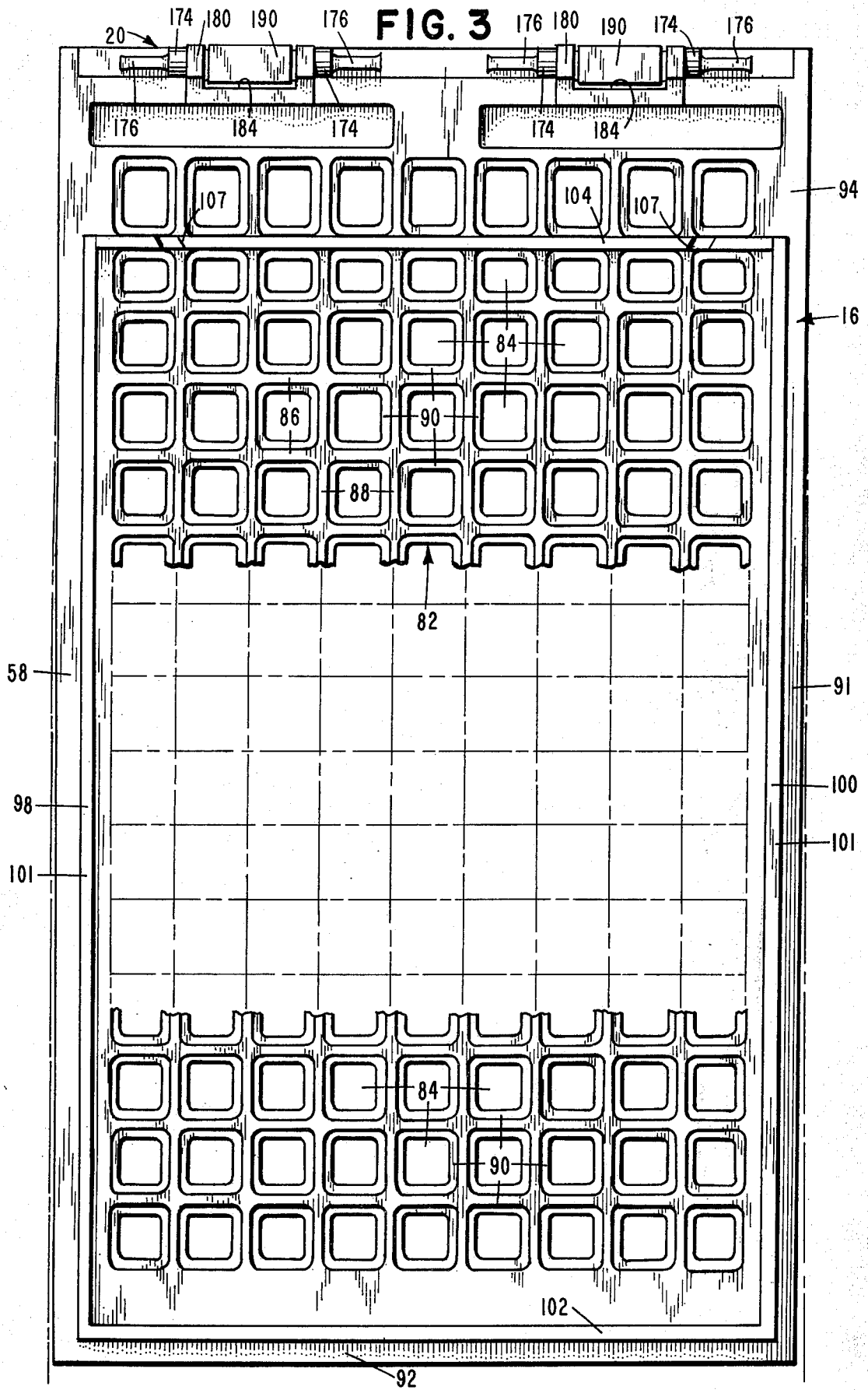
FIG. 3 is a rear elevation of the box shown in FIG. 1.

The rear panel 16 is shown in detail in FIG. 3. Rear panel 16 is also of lattice construction, having a lattice portion 82 having lattice openings 84. However, rear panel 16 is so constructed as to possess greater strength than front panel 10 and side panels 12 and 14. This is because rear panel 16 must be capable of supporting the entire weight of liquid contained in the bag when the box is horizontally oriented, with rear panel 16 facing downwardly, during storing and stacking. A plurality of horizontal ribs 86 and vertical ribs 88 are present. However, each lattice opening 84 is defined by a shoulder 90 extending from ribs 86 and 88. The openings 84 themselves are thus smaller than the lattice openings in the other panels, and there is more solid mass present in this panel. Horizontal ribs 86 terminate in corner members 58 and 91, which are inclined inwardly from top to bottom.

Figure 7:
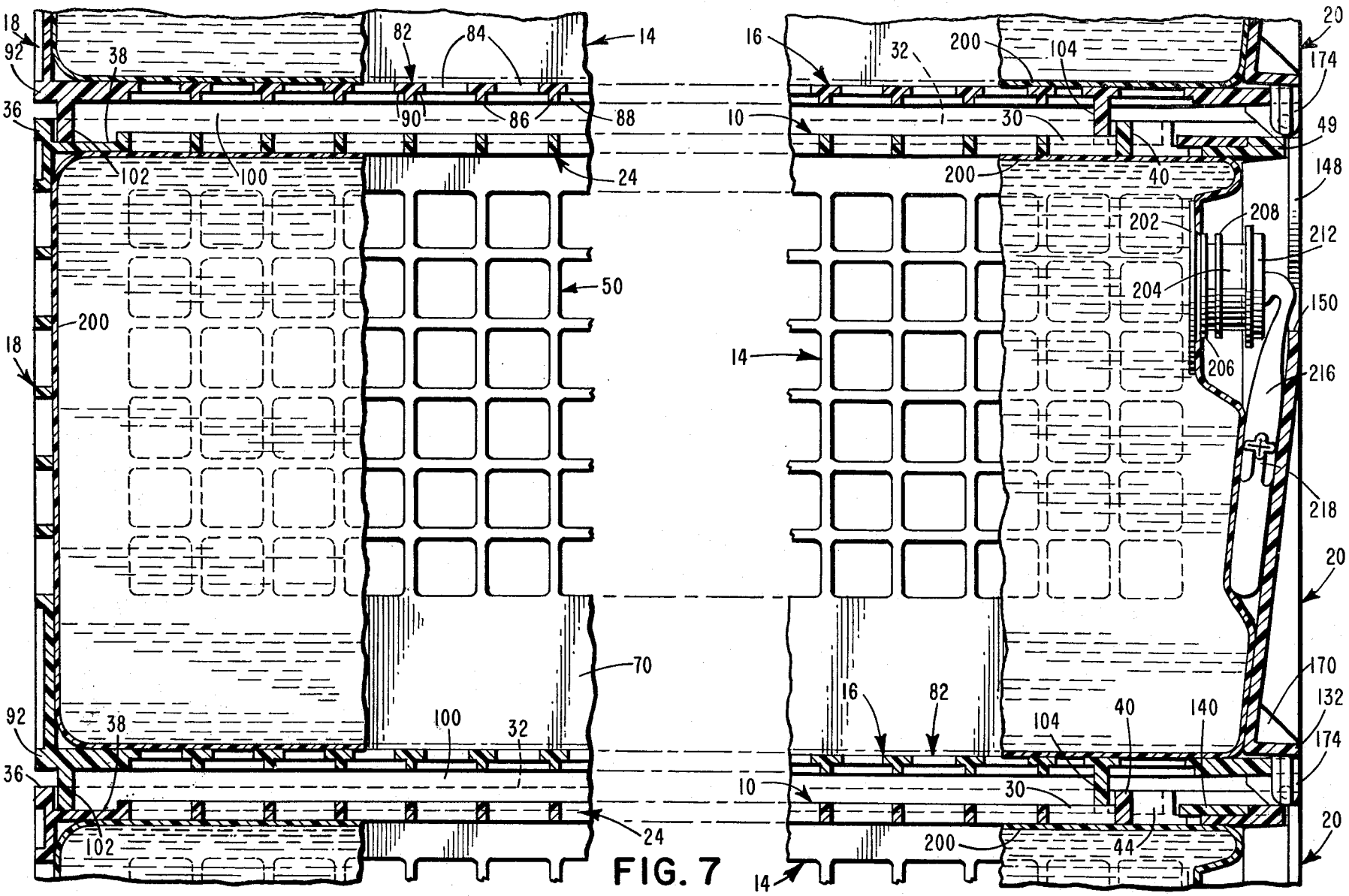
FIG. 7 is a view taken through line 7—7 of FIG. 2, showing a sectional view of a plurality of the boxes of FIG. 1 stacked for storage with liquid dispensing bags inside.

A bottom solid section 92 is integral with corner members 58 and 91, as is a solid section 94. Upstanding from the surface of corner members 58, 91, 92 and 94 are side legs 98 and 100, bottom leg 102, and top leg 104. Side legs 98 and 100 terminate in a stacking surface 101 that is outwardly inclined from top to bottom so that they compensate for the inward inclination of the back panel to which they are attached and the front panel of an adjacent box. Looking to FIG. 4, it is seen that corner member 58 and rear panel 16, are inclined from a vertical axis 103 so that there is an inward offset 105 at the bottom. Legs 98 and 100 are outwardly inclined from the vertical axis 103 so that there is an outward offset 106 at the bottom which is twice the magnitude of inward offset 105. Therefore, leg 102 is of greater length than leg 104 (FIG. 7). By this arrangement, when a plurality of boxes are stacked, the panels 18 and 20 are all parallel to one another in the same plane. Legs 98, 100, 102 and 104 are set inwardly from the edges of rear panel 16 a predetermined distance, so that they are received upon the front panel 10 of an adjacent box within the recessed area 38 bounded by corner members 32 and 34, bottom member 36, and rib 40, resting upon lattice members 30.

Bottom panel 18 (FIG. 6) has a central open lattice portion comprising a plurality of lattice openings 110 defined by lattice members 112 and 114. Transverse strengthening ribs 116 and 118 divide the remainder of panel 18 into solid sections 120, 122, 124 and 126. Edge members 36, 74 and 92 form the perimeter of the panel. Solid section 124 is at the lower portion of bottom panel 18 when the box rests upon back panel 16, during storage and stacking. Thus, a portion of higher strength is provided to resist the force of the liquid inside.

The construction of the top panel, which in this embodiment is the lid, is shown in FIGS. 1, 5, 7, 9 and 10. Lid 20 comprises front edge member 130, rear edge member 132, and a pair of side edge members 134 and 136. Channels 138 run the entire length of edge members 134 and 136, to receive, in interlocking relationship, the upper edge of solid section 76 of each of side panels 12 and 14. Extending downwardly from front edge member 130 is a lip 140, at a right angle to the plane of the edge members 134 and 136. Lip 140 is provided with an opening 142 so positioned as to be engageable with protrusion 49, to fasten lid 20 in the closed position. Lip 140 is flexible enough to be flexed outwardly over protrusion 49 during opening and closing of lid 20. In order to disengage lip 140 from protrusion 49, and open lid 20, a finger is inserted into opening 44 in front panel 10, and lip 140 is pulled outwardly and upwardly.

A flat section 146 extends inwardly from front edge member 130. A compound opening 147 is present in section 146, comprising an enlarged portion 148 and a smaller portion 150. The neck and spout of the liquid containing bag is accommodated in opening 147, as described below. Four strengthening ribs 152, 154, 156 and 158 radiate outwardly from section 146, to the corners of lid 20. These ribs taper outwardly toward the corners, to define and support five solid sections 160, 162, 164, 166 and 168, which are sloped inwardly (as viewed in FIG. 1) from section 146 toward the edge members. Therefore, when the box is inverted to the liquid dispensing position, the taper in the lid will allow complete drainage of the bag.

Figure 5:
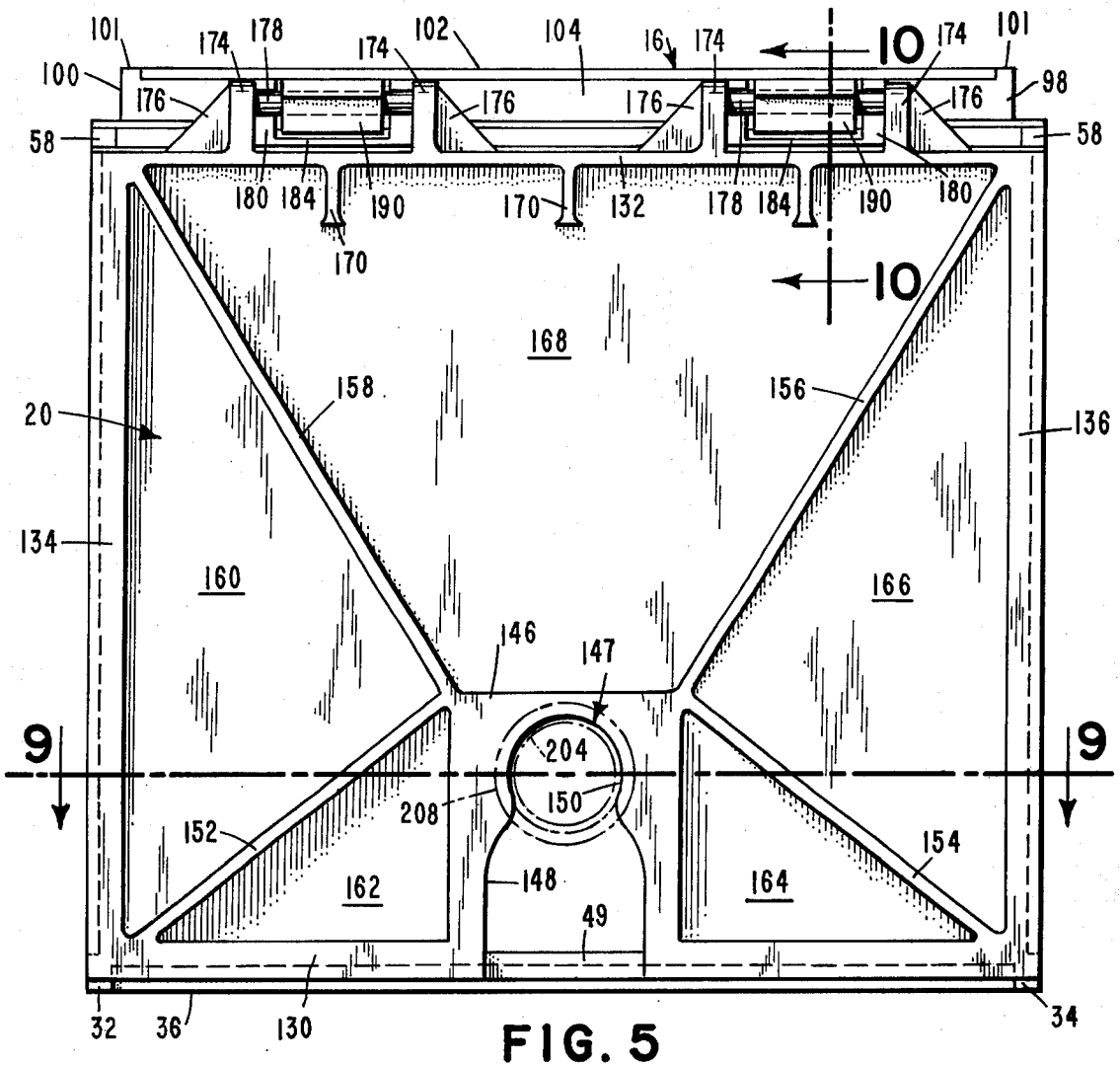
FIG. 5 is a top plan view of the box shown in FIG. 1.
Figure 11:
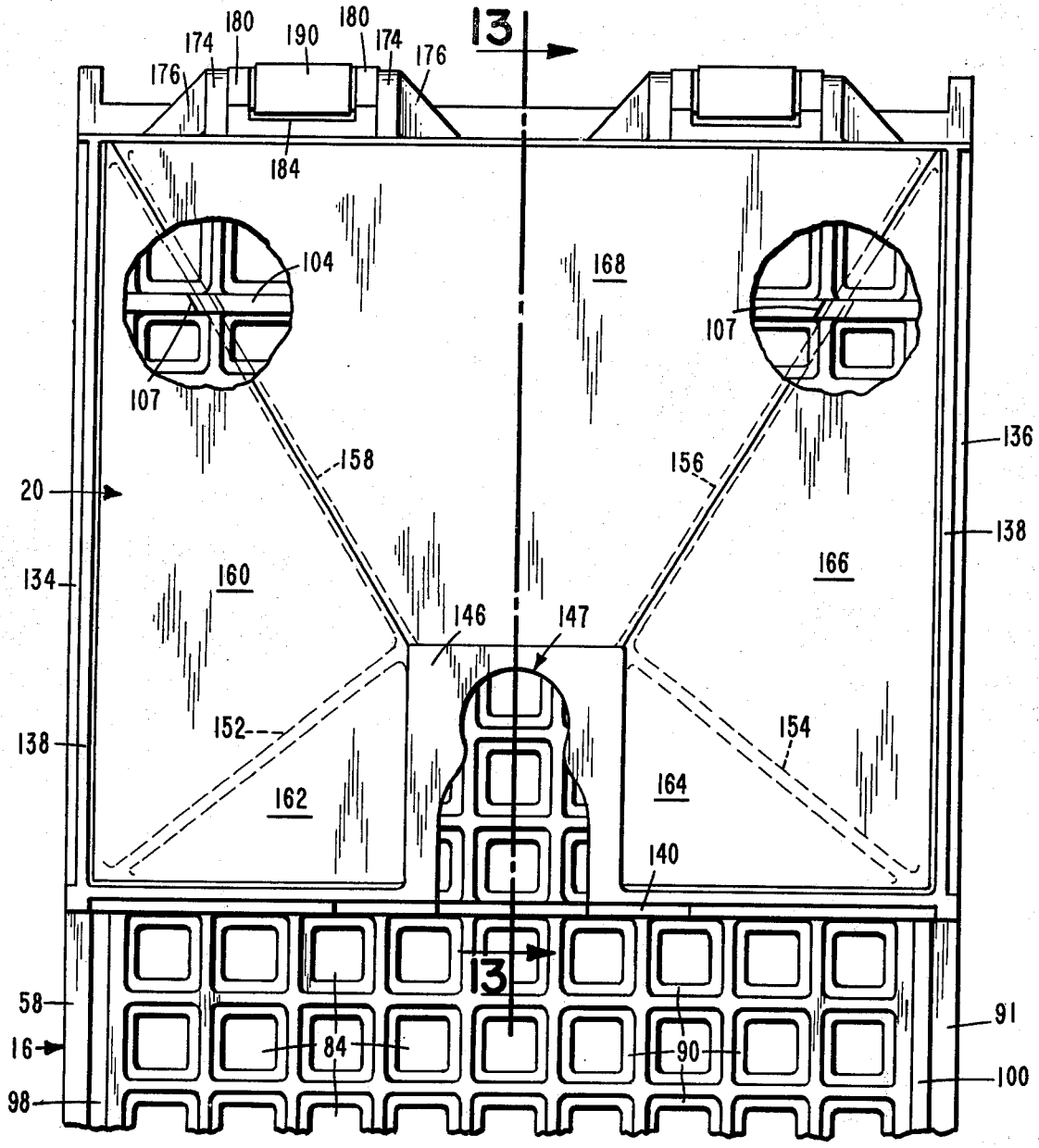
FIG. 11 is a rear elevational view of the box of FIG. 1 with the lid in the full open position.
Figure 10:
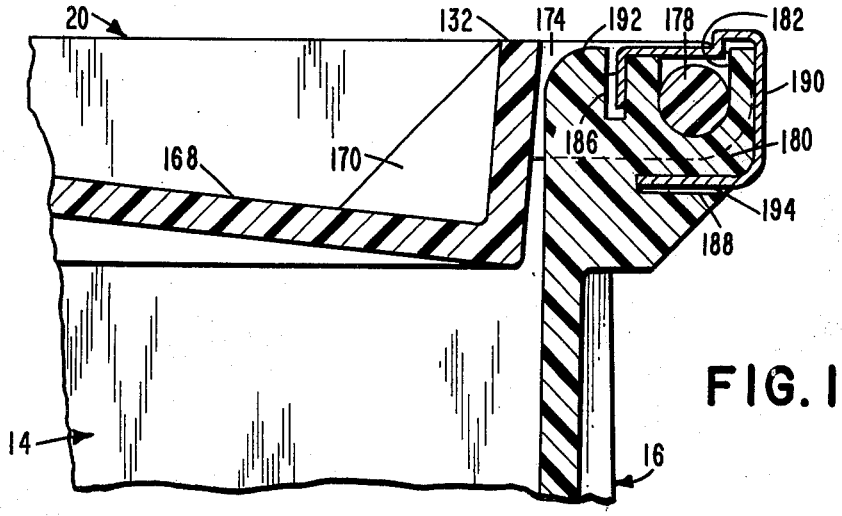
FIG. 10 is a view taken through line 10—10 of FIG. 5, showing particularly the details of the lid hinge construction.
Figure 13:
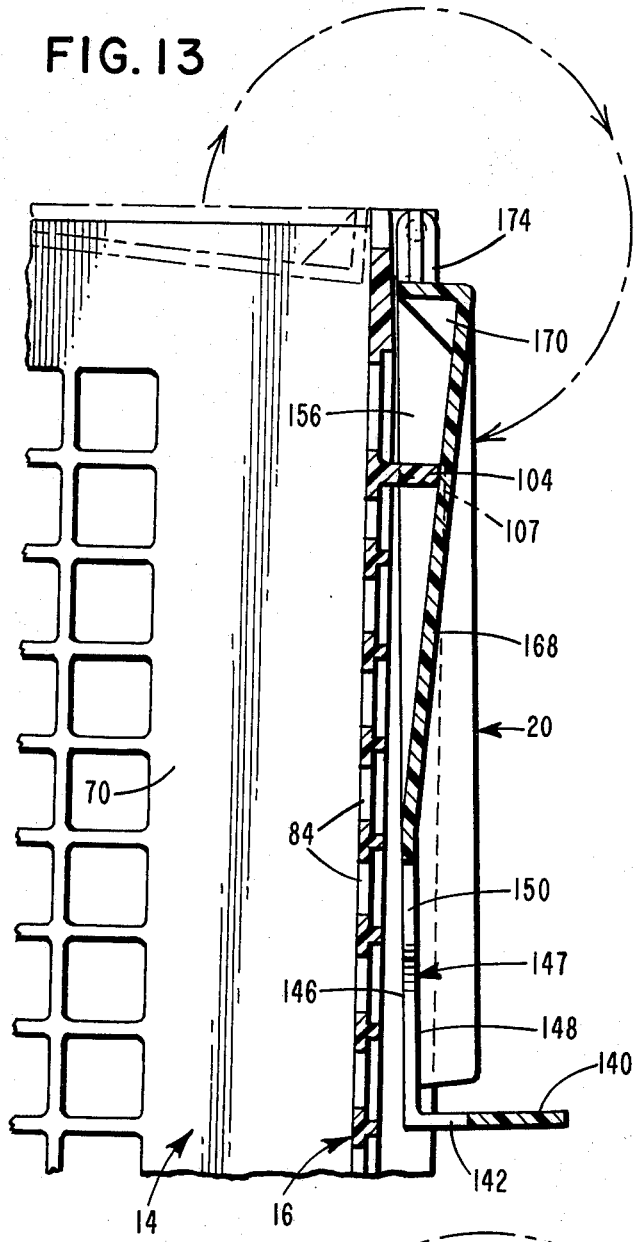
FIG. 13 is a view taken through line 13—13 of FIG. 11.
Figure 21:
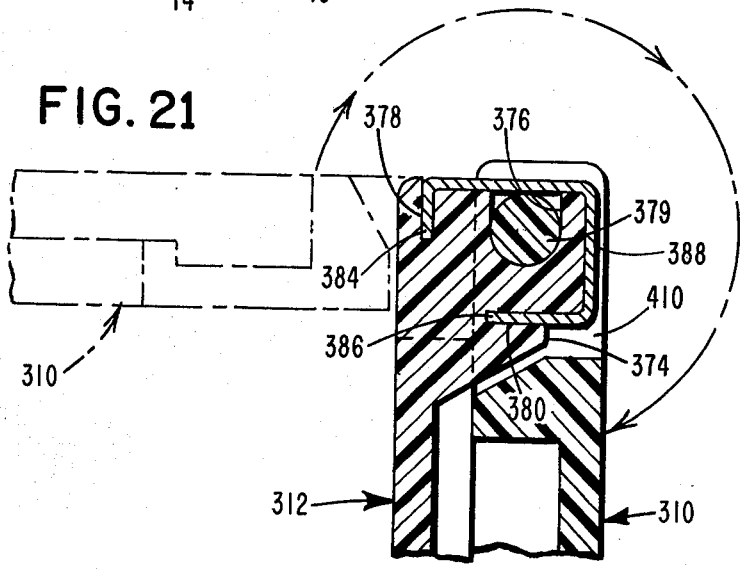
FIG. 21 is a view taken through line 21—21 of FIG. 14, showing particularly the details of the lid hinge construction.

Edge member 132 is provided with several triangular braces 170, to stiffen the lid hinge structure, shown best in FIGS. 1, 5 and 10. Extending outwardly and rearwardly from edge member 132 are two pairs of opposed bosses 174, each having a triangular side brace 176 (See FIG. 5). A shaft 178 is supported by each pair of bosses 174. Formed in the upper portion of back panel 16 are a pair of hinge elements 180, each having a longitudinal recess 182 for receiving shaft 178, and a cut-out section 184. Each hinge element further comprises a horizontal groove 186 and a vertical groove 188 (FIG. 10). The hinge construction is completed by a flat metal spring clip 190 of generally U-shaped cross-section having a first flange 192 extending into groove 186 and a second flange 194 extending into groove 188. Spring clip 190 holds shaft 178 in recesses 182, and is installed by snapping it into place in grooves 186 and 188. It can easily be removed. The hinge design is such that lid 20 can be pivoted from its closed position to a full open position flat against the outside of back panel 16 (FIG. 11). Strengthening ribs 156 and 158 extend into notches 107 in leg 104 when lid 20 is in the full open position as seen in FIGS. 11 and 13.

The liquid in the box is contained in a bag 200 made of thin plastic film. Bag 200 has a circular collar 202, from which extends a neck 204. A pair of spaced outer flanges 206 and 208 are formed on neck 204, as is an inward flange 210. A cap 212 fits into neck 204, being secured in place by engagement with flange 210. Cap 212 has a dispensing outlet 214 to which is attached a dispensing tube 216. The free end of tube 216 is closed, such as by crimping at 218.

For the filling operation, the box is normally placed on bottom panel 18, as shown in FIG. 1. Lid 20 is pivoted to the full open position, and bag 200 is placed within the box. At this point, cap 212 is not yet installed. Collar 202 is positioned at that point at which opening 147 of lid 20 will be present when lid 20 is closed. Bag 200 is then filled with liquid through collar 202, and upon completion of the filling cap 212 is installed. Tube 216 is then folded against the top of the filled bag 200, where it remains until immediately prior to use. Lid 20 is pivoted to the closed position, where projection 49 engages opening 142 to fasten the lid closed.

Figure 8:
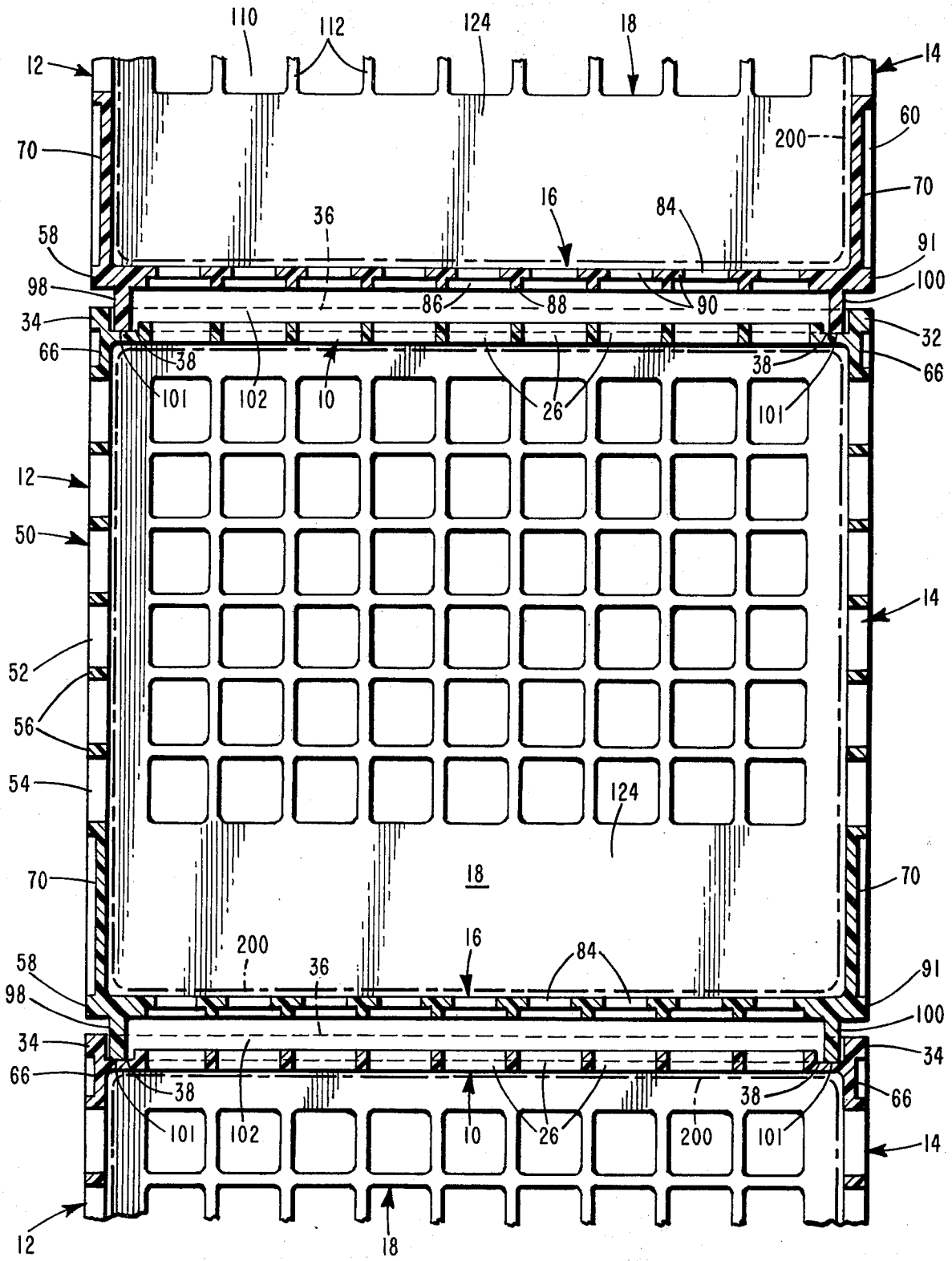
FIG. 8 is a view taken through line 8—8 of FIG. 2, showing an end view of a plurality of the boxes of FIG. 2 stacked for storage.

The box can now be placed on back panel 16 for handling, shipping and storing. In such position, it rests upon legs 98, 100, 102 and 104. A number of filled boxes can be stacked upon one another, as shown in FIGS. 7 and 8. The outwardly tapered configuration of legs 98, 100, 102 and 104 compensates for the inward taper of the boxes so that they stack horizontally. The rectangular pattern of legs 98, 100, 102 and 104 fits closely within the rectangular outline of corner members 32, 34 and 36, and rib 40 of front panel 10, thus interlocking the stacked boxes.

Figure 12:
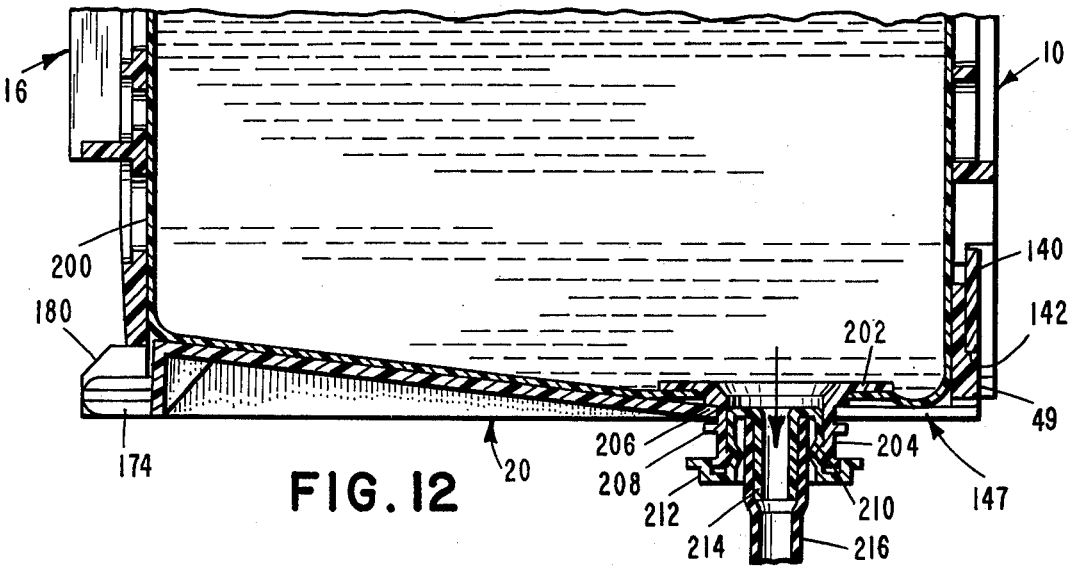
FIG. 12 is a sectional view of a portion of the box in its inverted position for dispensing liquid.

To utilize the box in a typical liquid dispenser, such as a refrigerated restaurant milk dispenser, the box is first placed on bottom panel 16, and lid 20 is opened. Tube 216 is extended from bag 200, and passed through opening 147 in lid 20 as the lid is returned to the closed position. Neck 204 is positioned in the larger portion 148 of opening 147 and then, when lid 20 is completely closed, neck 204 is pressed into the smaller portion 150 of the opening, so that panel 146 is flanked by flanges 206 and 208. The size of portion 150 of opening 147 is such that neck 204 is retained therein. The box can now be inverted and placed in the refrigerated dispenser (not shown) oriented as in FIG. 12. Tube 216 is connected to a conventional dispenser valve mechanism, and the crimped end 218 is cut off to allow liquid to flow therethrough.

When the liquid has been exhausted, the box is removed from the dispenser and bag 200 is discarded. The box can then be cleaned and sanitized for reuse, this being facilitated by the open lattic construction and the absence of seams and fasteners. The lid can easily be removed for cleaning by snapping spring 190 from grooves 186 and 188, thus freeing shaft 178.

A second embodiment of the invention is shown in FIGS. 14–22. The inventive concepts are the same as with the first embodiment described above, the chief difference being in the fact that the lid in this second embodiment is on the side of the structure, instead of on the top, as in the other embodiment.

The box of this embodiment has a front lid panel 310, left side panel 312, right side panel 314, a back panel 316, a bottom panel 318, and a top panel 320.

Back panel 316 has a lattice portion 324 comprising a plurality of lattice openings 326 defined by shoulders 328, horizontal lattice members 330, and vertical lattice members 332. Corner members 334, 336, and 338 and 340 form the perimeter of this panel. A rectangular frame 342 extends outwardly from corner members 334–340, to interlock with the top panel of a box underneath in a stack, as explained below. Because back panel 316 must support the entire weight of the liquid in the box when the box is stacked, lattice portion 324 is of heavier construction than the lattice portions of the other panels.

Figure 16:
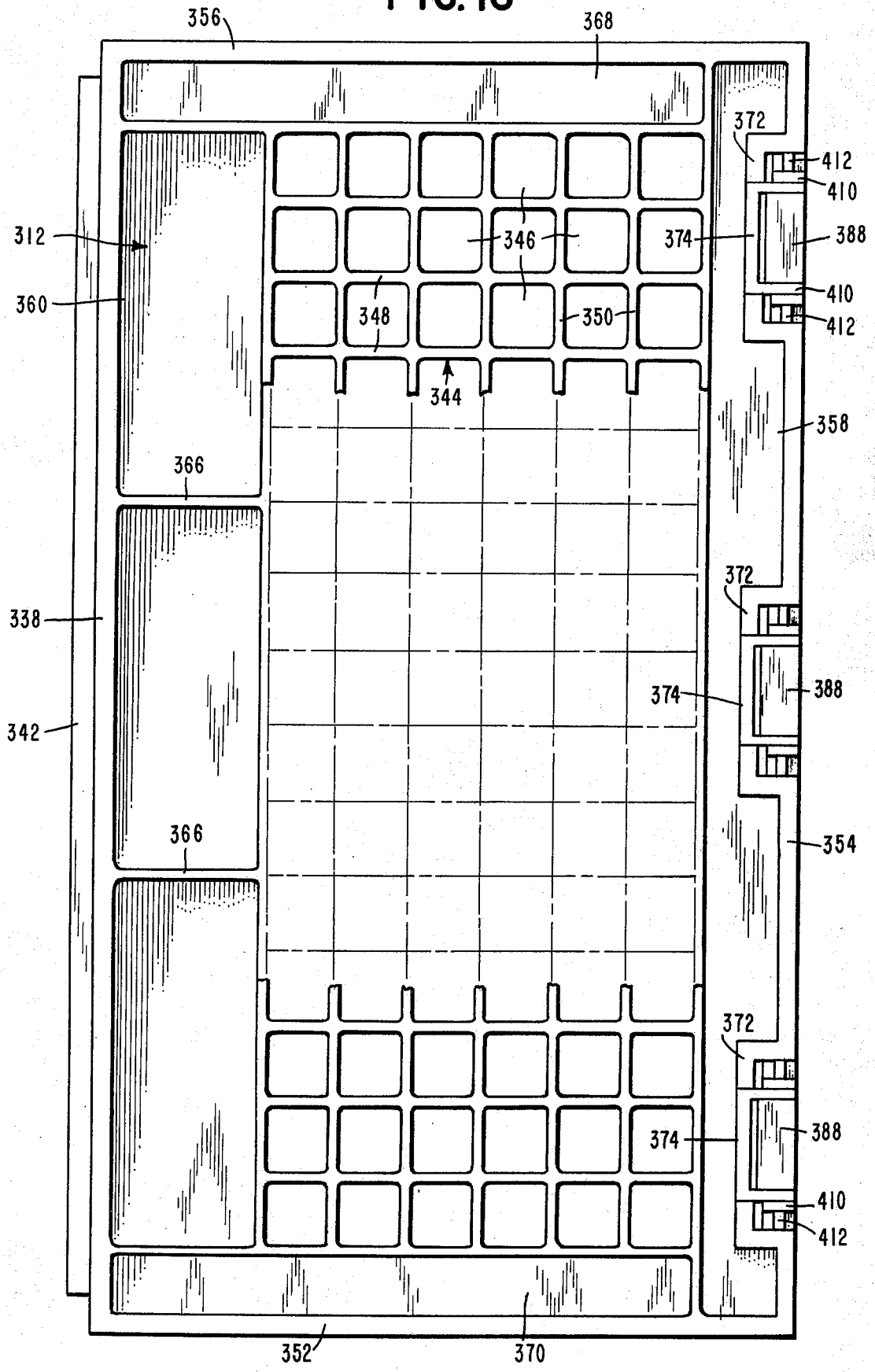
FIG. 16 is a side elevational view of the box shown in FIG. 14.
Figure 17:
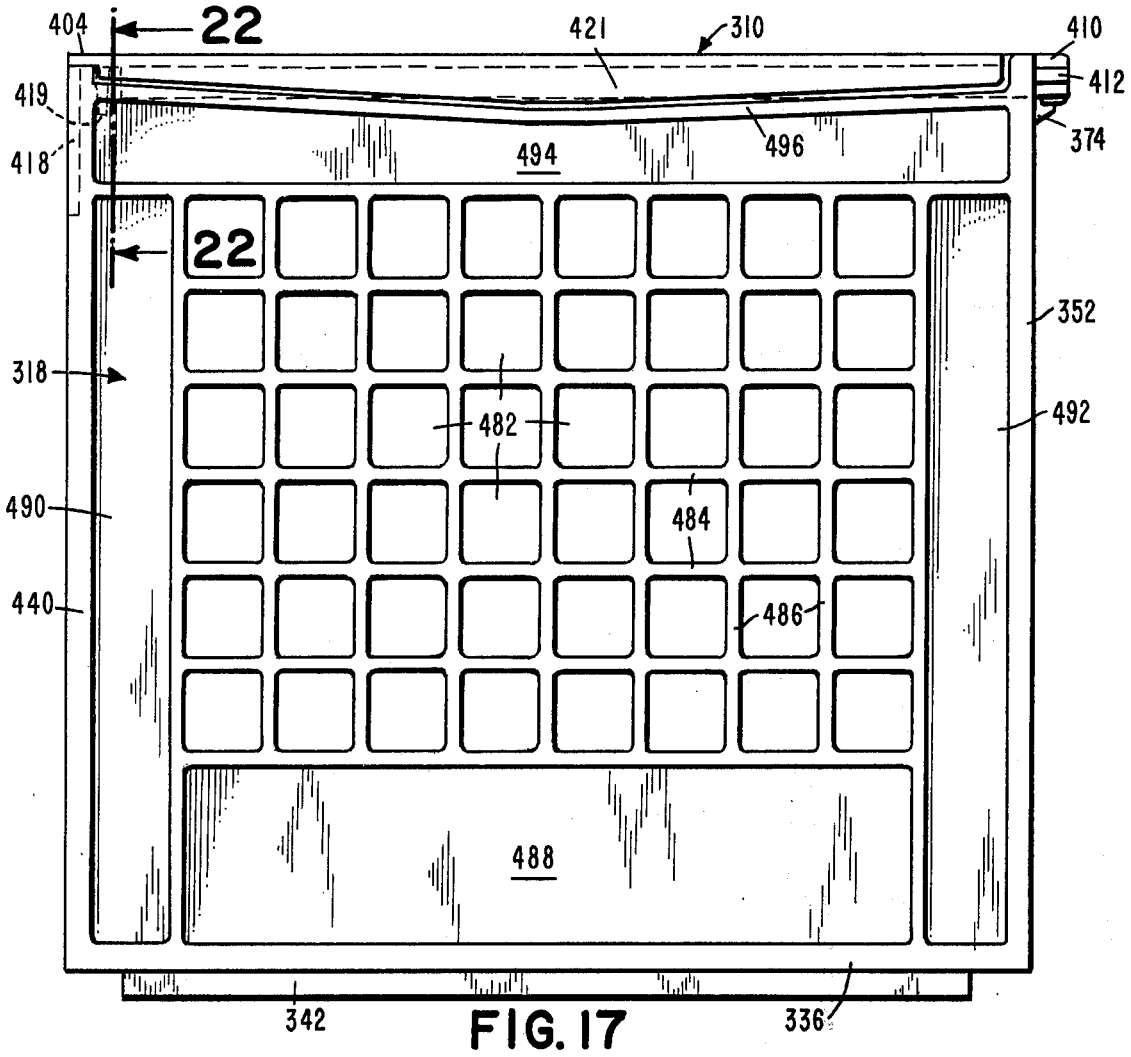
FIG. 17 is a bottom plan view of the box shown in FIG. 14.
Figure 18:
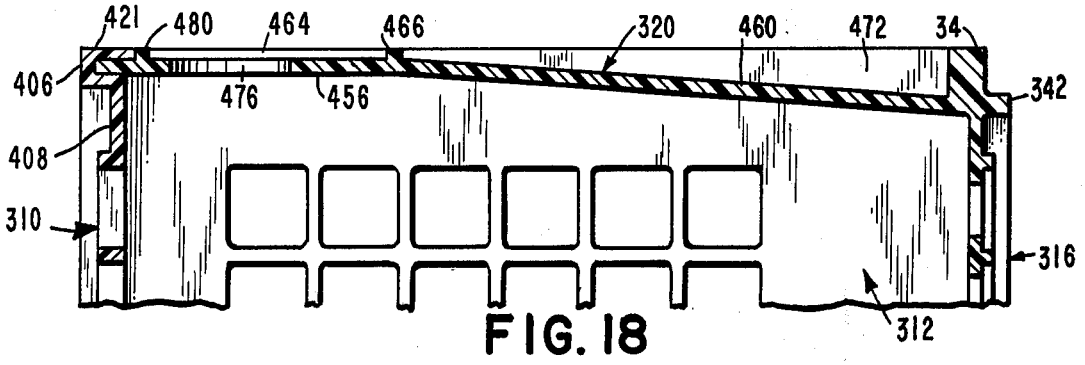
FIG. 18 is a view taken through line 18—18 of FIG. 14.
Figure 19:
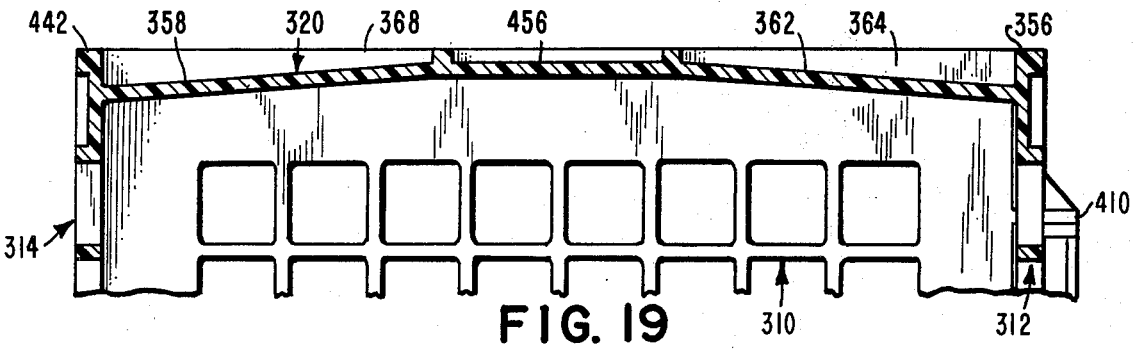
FIG. 19 is a view taken through line 19—19 of FIG. 14.

Left side panel 312 is shown in FIG. 16. It has a lattice portion 344 comprising lattice openings 346 defined by horizontal lattice members 348 and vertical lattice members 350. Left side panel 312 is rimmed by corner members 338, 352, 354 and 356. The hinges are mounted on left side panel 312. To provide extra strength at the hinge points, a solid section 358 is provided, adjacent to corner member 354. An additional solid section 360, reinforced by ribs 366, provides extra strength to accommodate the increased pressure placed upon that part of panel 312 when the box rests upon back panel 316. Finally, additional end strength is provided by solid sections 368 and 370.

Corner member 354 includes three offset portions 372 to accommodate the hinge elements 374 mounted on left side panel 312. Each hinge element comprises (FIG. 21) a recess 376 for receiving the hinge shaft (described below), and first and second grooves 378 and 380 for receiving flanges 384 and 386 of a hinge spring 388.

In this embodiment the front panel functions also as the lid. Front panel 310 (FIG. 14) comprises a lattice portion 390 having lattice openings 392 defined by horizontal lattice members 394 and vertical lattice members 396. Front panel 310 is provided with edge members 400, 402, 404 and 406, adjacent to which is a circumscribing solid section 408. Attached to edge member 400 are three pairs of bosses 410, each of which is strengthened by a brace 412. Supported between each pair of bosses 410 is hinge shaft 379, which is seated in grooves 376, being held therein by hinge spring 388. A closure lip 416 is attached to front panel 310 at a right angle thereto. Lip 416 has a pair of tongue portions 418, and a pair of fastening openings 420. Side lips 421 also extend from panel 310 perpendicularly to corner members 402 and 406, at both the top and the bottom of the panel.

Figure 22:
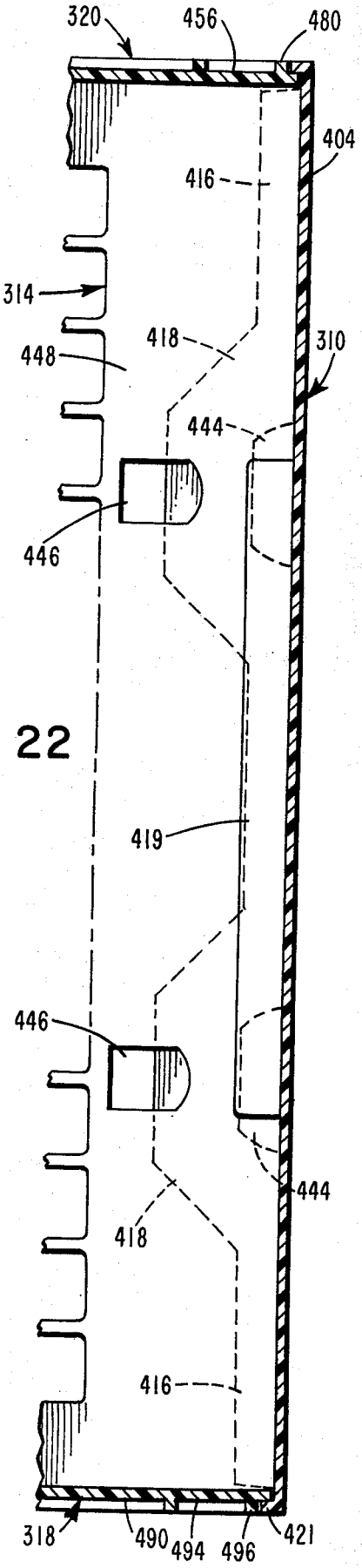
FIG. 22 is a view taken through line 22—22 of FIG. 17.
Figure 14:
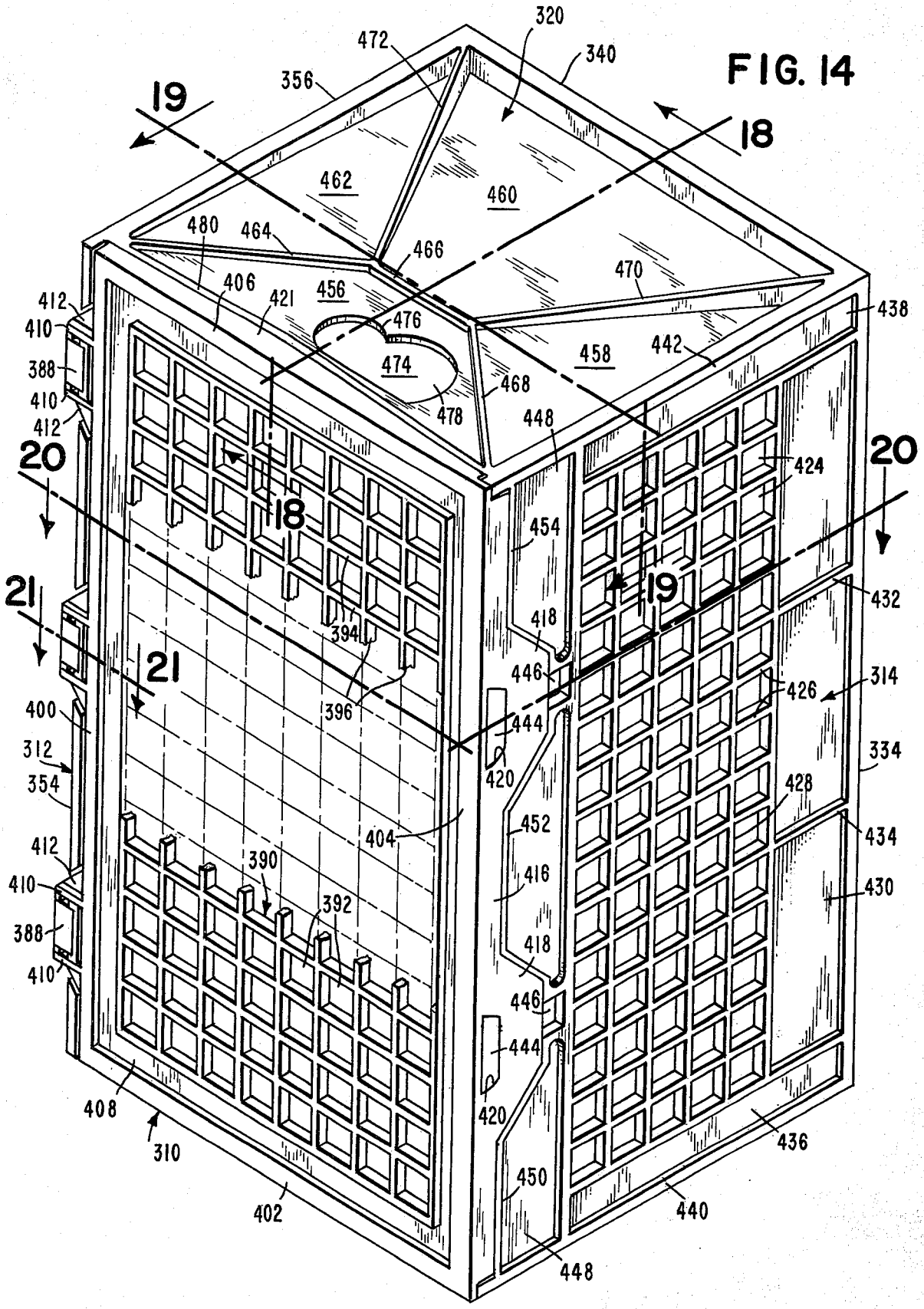
FIG. 14 is an isometric view of a second embodiment of a box constructed in accordance with the teachings of the invention.
Figure 15:
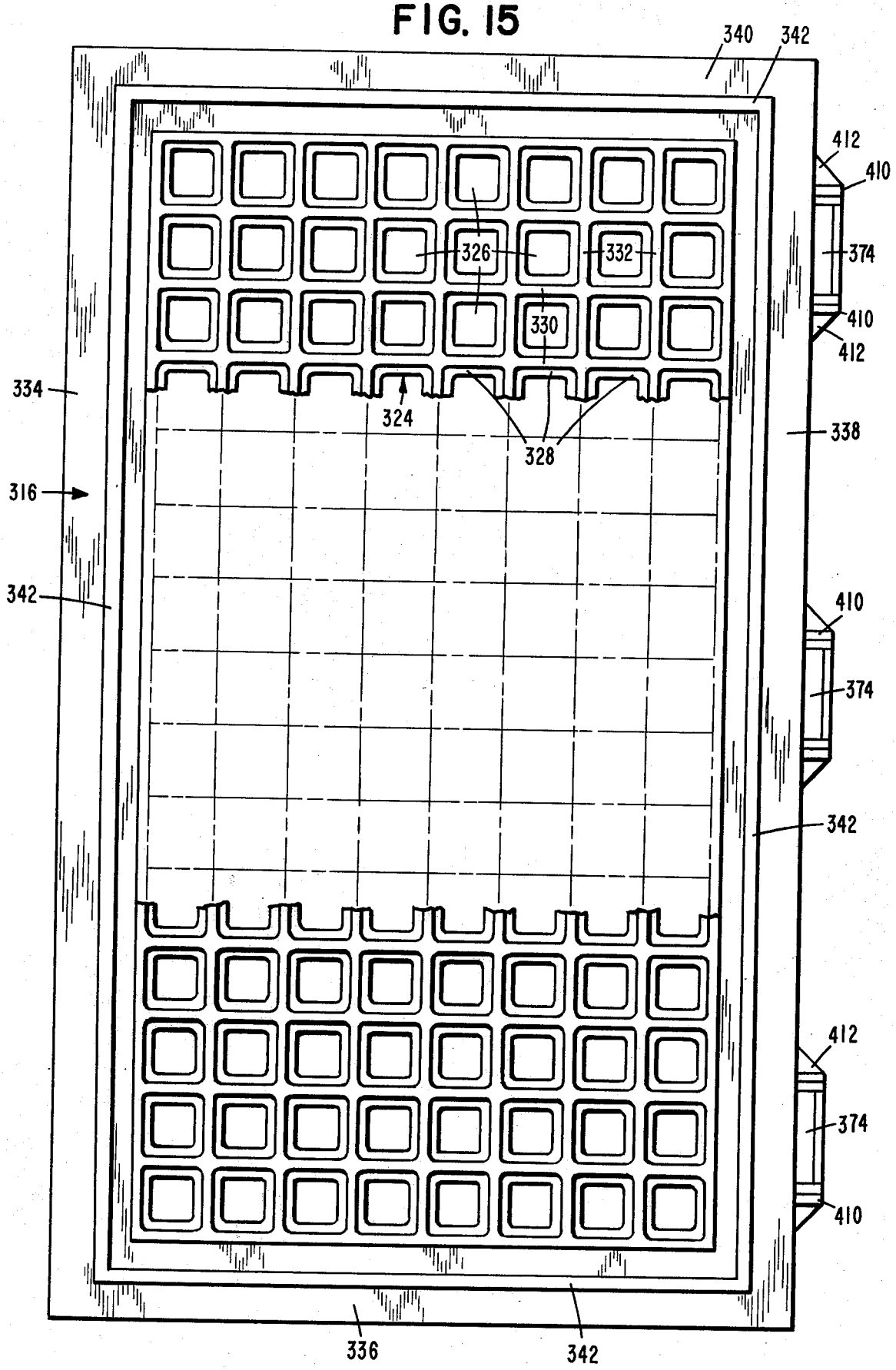
FIG. 15 is a rear elevational view of the box shown in FIG. 14.

Right side panel 314 (FIG. 14) is quite similar to left side panel 312, comprising lattice openings 424, horizontal lattice members 426, vertical lattice members 428, a solid section 430, with strengthening ribs 432, and 434, and additional solid sections 436 and 438. Corner members 334, 440, and 442 demark the edges of panel 314. Additionally, right side panel 314 carries lid fastening elements, in the form of a pair of fastening protrusions 444 and openings 446. This fastening mechanism works exactly like that which was disclosed above in regard to the first embodiment of the invention. An additional solid section 448 is reinforced by ribs 450, 452 and 454, which are contoured to match the shape of lip 416. Fastening protrusions 444 are mounted on that portion of section 448 that is beneath lip 416 in FIG. 14. A reinforcing rib 419 parallel to and spaced laterally from lip 416 is formed on the back side of edge member 404. Rib 419 extends longitudinally from one fastening protrusion 444 to the other as seen in FIG. 22. The rib 419 is spaced from lip 416 a distance approximately the thickness of solid section 448 of right side panel 314. This insures that side panel 314 cannot be distended inwardly by a force from outside at an angle to the panel, or by the vertical loading present during stacking.

Top panel 320 in this embodiment is integral with side panels 312 and 314, and back panel 316. Corner members 340, 442 and 356 bound solid sections 456, 458, 460 and 462, which are also outlined by ribs 464, 466, 468, 470 and 472. Sections 458, 460 and 462 are inclined, as were the similar sections in the lid of the first embodiment of the invention, to allow complete drainage of liquid from the bag when the box is inverted to the dispensing position. Section 456 is flat, and contains an opening 474 having a small portion 476 and an enlarged portion 478. A contoured rib 480 complements the shape of lip 421, which extends over the outer portion of section 456 when front lid panel 310 is closed.

Bottom panel 318 (FIG. 17) comprises a lattice portion having lattice openings 482, horizontal lattice members 484, and vertical lattice members 486. A solid section 488 is at that portion of panel 320 which is the lower portion when the box is placed on back panel 316, to provide the increased resistance to the pressure of the fluid. A pair of solid panels 490 and 492 flank the lattice portion. The perimeter of panel 418 is defined by corner members 336, 352 and 440. The final solid section 494 is provided with a contoured rib 496, that complements the contour of the bottom lip 421, which extends over the upper portion of section 494 when front lid panel 310 is closed.

Figure 20:
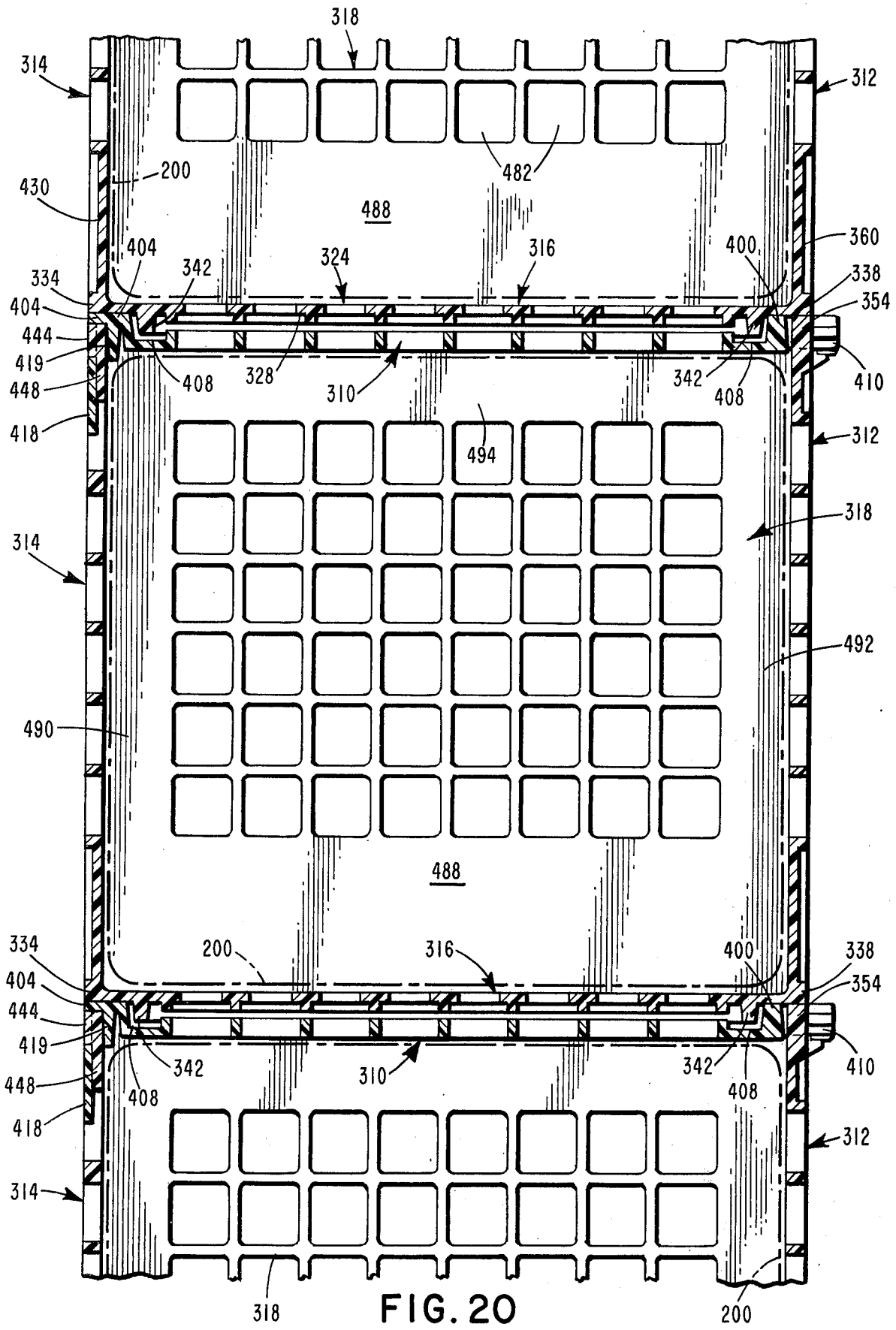
FIG. 20 is a sectional view taken through line 20—20 of FIG. 14, showing a plurality of the boxes of FIG. 14 stacked for storage.

In this embodiment of the invention, the panels are not inwardly tapered. Also, the interrelationship of stacked boxes differs from that of the first embodiment. This is shown in FIG. 20. Legs 342 do not rest upon the lower box, but functions only as an interlock to facilitate stacking. Legs 342 are thus shorter than the height of corner members 400, 402, 404 and 406 above solid section 408. Therefore, the peripheral portion of the corner members 334, 336, 338 and 340, of rear panel 316, will rest upon the peripheral portions of three of the corner members 402, 404 and 406 of front lid panel 310, plus the corner member 354 of left side panel 312.

The operation of this embodiment is almost like that of the other embodiment, except that access to the interior of the box is via the hinged side panel. The neck of the liquid dispenser bag (not shown) and the tube extending therefrom (also not shown) are left within the box until the box is to be positioned for dispensing. Then, with the box resting on back panel 316, front panel 310 is opened and the tube and neck of the bag are pulled through opening 478. The neck is then secured in opening 476. The box is then placed in the dispenser cabinet upon top opening 476 of panel 320, and used in the manner described with the other embodiment.

While many modifications and variations of the above described embodiments may become evident to one skilled in the art upon a reading of this disclosure, it should be understood that the scope of the invention is not limited to these embodiments, but is defined by the appended claims:

I claim:

1. A box for encasing a thin film bag containing liquid comprising:

first, second, third and fourth side panels and an end panel each of substantially rectangular shape attached together along their contiguous side edges to form a substantially quadratic box having an open and opposite said end panel, said first and third side panels and said second and fourth side panels, respectively, being opposite one another, a plurality of first strengthening corner members, one of said first corner members being at the intersection of each adjacent pair of said side panels, a plurality of second strengthening corner members, one of said second corner members being located at the intersection of said end panel with each of said side panels, said first and second corner members being integrally joined together, said first side panel being substantially entirely of first open lattice construction of sufficient strength to support the weight of said bag and the contents thereof when said box rests upon said first side panel, said third side panel being substantially of open lattice construction, said second and fourth side panels each comprising a first portion adjacent to said first side panel and extending along the entire distance between said end panel and said open end, said first portion being of solid construction of sufficient strength to withstand the pressure of said bag and the contents thereof when said box rests upon said first side panel, and a second portion of open lattice construction adjacent to said third side panel and extending along a major portion of the distance between said end panel and said open end, said end panel comprising a first end panel portion adjacent to said first side panel and extending along substantially the entire length of said end panel, said first end panel portion being of solid construction of sufficient strength to withstand the pressure of said bag and the contents thereof when said box rests upon said first side panel, and a second end panel portion substantially entirely of open lattice construction adjacent to said third side panel, said open lattice of said first side panel being of heavier construction than said open lattice of said second, fourth and end panels, a lid panel hingedly attached to one of said side panels at said open end and movable between an open position and a closed position, said lid panel being of sufficient strength to support the weight of said bag and the contents thereof when said box rests upon said lid panel, hinge means for hingedly attaching said lid panel to one of said side panels, fastening means for releasably fastening said lip panel in said closed position, first support means on said first side panel to support said box when said box rests upon said first side panel, and second support means on said lid panel to support said box when said box rests upon said lid panel.

2. The box of claim 1 wherein said lid is of solid construction and comprises a dispenser opening through which a liquid dispensing means can be extended and interior surfaces to support said bag, said interior surfaces being inclinded toward said dispenser opening to promote drainage of liquid from said bag when said box rests upon said lid.

3. The box of claim 1 wherein said first support means comprises legs extending outwardly from each of said first strengthening corner members flanking said first side panel and said second strengthening corner member adjacent to the intersection of said first side panel and said end panel, and wherein said third side panel comprises a recess adjacent to said first strengthening support members flanking said third side panel and said second strengthening support member at the intersection of said third side panel and said end panel to receive in interlocking relationship said first support means of another said box when a plurality of boxes are stacked atop one another resting upon said first side panels.

4. The box of claim 1 wherein said fastening means comprises a projection formed on said third side panel adjacent to said end opening and a flexible lip carried by said lid, said flexible lip overlapping said projection when said lid is closed and having a fastening opening engageable by said projection when said lid is in the closed position, said third side panel further comprising a lip disengagement opening adjacent to said projection and positioned partially beneath said lip when said lip overlaps said projection, whereby said lip can be disengaged from said projection to move said lid to the open position.

5. The box of claim 1 wherein said hinge means comprises means defining an elongated open recess carried by said first side panel and a hinge shaft carried by said lid panel, said hinge shaft being receivable in said recess, and a removable spring clip for closing said open recess, said spring clip being attachable to said first panel at points flanking said open recess.

6. The box of claim 1 wherein said side panels and said end panel are of integrally molded construction, wherein said first side panel and said first strengthening corner members flanking said first side panel and said third side panel and said first strengthening corner members flanking said third side panel are inclined slightly inwardly from said open end toward said end panel, and wherein said first support means are inclined outwardly from said first side panel sufficiently to compensate for the inward inclination of said first side panel and said third side panel of an adjacent one of said boxes in a stack so that upon stacking of a plurality of said boxes the said lid panels and end panels of all said boxes will be parallel to one another.

7. The box of claim 1 further comprising an inner shoulder formed on said lid panel adjacent the free edges thereof, said inner shoulder being substantially parallel to said adjacent side panels when said lid panel is in the closed position and being spaced inwardly from the free edges of said lid panel sufficient distance to be in juxtaposition to the inner surfaces of the said side panels when said lid panel is in the closed position, to thereby strengthen said side panels against inward movement thereof.

8. The box of claim 7 further comprising an outer flange formed on said lid panel along the free edges thereof, said outer flange being spaced from said inner shoulder a distance substantially equal to the thickness of said side panels at corresponding points thereon, said side panels being received between said inner shoulder and said outer flange when said lid panel is in the closed position.

9. The box of claim 8 wherein said fastening means comprises a projection formed on one of said side panels and a flexible lip carried by said lid panel having a fastening opening engageable with said projection, said flexible lip being integral with said outer flange.

10. A box for encasing a thin film bag containing liquid comprising:

first, second and third side panels and first second end panels each of substantially rectangular shape attached together along their contiguous side edges to form a substantially quadratic box having an open side opposite said first side panel, said second and third side panels being opposite one another, a plurality of first strengthening corner members, one of said first corner members being at the intersection of each adjacent pair of said side panels, a plurality of second strengthening corner members, one of said second corner members being located at the intersection of said end panel with each of said side panels, said first and second strengthening corner members being integrally joined together, said first side panel being substantially entirely of first open lattice construction of sufficient strength to support the weight of said bag and the contents thereof when said box rests upon said first side panel, said second and third side panels each comprising a first portion adjacent to said first side panel and extending along the entire distance between said first and second end panels, said first portion being of solid construction of sufficient strength to withstand the pressure of said bag and the contents thereof when said box rests upon said first side panel, and a second portion of open lattice construction adjacent to said open side and extending along a major portion of the distance between said end panels, said first end panel comprising a first end panel portion adjacent to said first side panel and extending along substantially the entire length of said end panel, said first end panel portion being of solid construction of sufficient strength to withstand the pressure of said bag and the contents thereof when said box rests upon said first side panel, and a second end panel portion substantially entirely of open lattice construction adjacent to said open side, said second end panel being of sufficient strength to support the weight of said bag and the contents thereof when said box rests upon said second end panel, a side lid panel hingedly attached to said second side panel at said open side and movable between an open position and a closed position, said side lid panel being substantially entirely of open lattice construction, said open lattice of said first side panel being of heavier construction than said open lattice of said second and third side panels, said side lid panel, and said first end panel, hinge means for hingedly attaching said side lid panel to said second side panel, fastening means for releasably fastening said side lid panel in said closed position, first support means on said first side panel to support said box when said box rests upon said first side panel, and second support means on said second end panel to support said box when said box rests upon said second end panel.

11. The box of claim 10 wherein said second end panel is of solid construction and comprises a dispenser opening through which a liquid dispensing means can be extended and interior surfaces to support said bag, said interior surfaces being inclined toward said dispenser opening to promote drainage of liquid from said bag when said box rests upon said second end panel.

12. The box of claim 10 wherein said first support means comprises legs extending outwardly from said first side panel, and wherein said side lid panel comprises third strengthening corner members about the periphery thereof and a recess adjacent to said third strengthening support members to receive in interlocking relationship said first support means of another said box when a plurality of boxes are stacked atop one another resting upon said first said side panels.

13. The box of claim 10 wherein said fastening means comprises a projection formed on said third side panel adjacent to said open side and a flexible lip carried by said side lid panel, said flexible lip overlapping said projection when said side lid panel is closed and having a fastening opening engageable by said projection when said side lid panel is in the closed position, said third side panel further comprising a lip disengagement opening adjacent to said projection and positioned partially beneath said lip when said lip overlaps said projection, whereby said lip can be disengaged from said projection to move said lid to the open position.

14. The box of claim 10 wherein said hinge means comprises means defining an elongated open recess carried by said second side panel and a hinge shaft carried by said side lid panel, said hinge shaft being receivable in said recess, and a removable spring clip for closing said open recess, said spring clip being attachable to said second panel at points flanking said open recess.

15. The box of claim 13 comprising a plurality of said projections and a plurality of said flexible lips.

16. The box of claim 10 further comprising an inner shoulder formed on said side lid panel adjacent the free edges thereof, said inner shoulder being substantially parallel to said third side panel and said first and second end panels when said side lid panel is in the closed position and being spaced inwardly from the free edge of said side lid panel sufficient distance to be in juxtaposition to the inner surfaces of said third side panel and said first and second end panels when said side lid panel is in the closed position, to thereby strengthen said third side panel and said end panels against inward movement thereof.

17. The box of claim 16 further comprising an outer flange formed on said side lid panel along the free edges thereof, said outer flange being spaced from said inner shoulder a distance substantially equal to the thicknesses of said third side panel and said first and second end panels respectively at corresponding points thereon, said third side panel and said first and second end panels being received between said inner shoulder and said outer flange when said side lid panel is in the closed position.

18. The box of claim 17 wherein said fastening means comprises a projection formed on said third side panel adjacent the free edge thereof and a flexible lip carried by said side lid panel and having a fastening opening engageable with said projection, said flexible lip being integral with said outer flange.

* * * * *